US011293438B2

(12) United States Patent
Tangudu et al.

(10) Patent No.: US 11,293,438 B2
(45) Date of Patent: Apr. 5, 2022

(54) SCREW COMPRESSOR WITH MAGNETIC GEAR

(71) Applicant: Carrier Corporation, Jupiter, FL (US)

(72) Inventors: Jagadeesh Tangudu, South Windsor, CT (US); Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 367 days.

(21) Appl. No.: 16/469,502

(22) PCT Filed: Dec. 13, 2017

(86) PCT No.: PCT/US2017/065990

§ 371 (c)(1),
(2) Date: Jun. 13, 2019

(87) PCT Pub. No.: WO2018/111985

PCT Pub. Date: Jun. 21, 2018

(65) Prior Publication Data

US 2020/0040898 A1 Feb. 6, 2020

Related U.S. Application Data

(60) Provisional application No. 62/434,742, filed on Dec. 15, 2016.

(51) Int. Cl.
*F01C 1/16* (2006.01)
*F03C 2/00* (2006.01)
(Continued)

(52) U.S. Cl.
CPC ..... *F04C 29/0064* (2013.01); *F04C 18/16* (2013.01); *F04C 2210/42* (2013.01); *F04C 2270/11* (2013.01)

(58) Field of Classification Search
CPC .. F04C 18/16; F04C 29/0064; F04C 2210/42; F04C 2270/11; F04C 2270/115
See application file for complete search history.

(56) References Cited

U.S. PATENT DOCUMENTS 3,885,402 A * 5/1975 Moody, Jr. ..... F04C 28/125 418/201.2
5,857,348 A 1/1999 Conry
(Continued)

FOREIGN PATENT DOCUMENTS

CN 104329253 A 2/2015
CN 204900256 U 12/2015
(Continued)

OTHER PUBLICATIONS

International Search Report; International Application No. PCT/US2017/065990; International Filing Date: Dec. 13, 2017; dated Feb. 15, 2018; 7 Pages.
(Continued)

*Primary Examiner* — Theresa Trieu
(74) *Attorney, Agent, or Firm* — Cantor Colburn LLP

(57) ABSTRACT

A screw compressor is provided including a casing having a suction port and a discharge port, a male rotor rotatable relative to the casing about a first axis, a female rotor rotatable relative to the casing about a second axis, and a magnetic gear system. The magnetic gear system includes a first magnetic gear associated with the male rotor and a second magnetic gear associated with the female rotor. The first magnetic gear and the second magnetic gear are positioned such that a magnetic field of the first magnetic gear interacts with the second magnetic gear to drive rotation of the female rotor about the second axis.

9 Claims, 3 Drawing Sheets

(51) Int. Cl.

| | |
|---|---|
| ***F03C 4/00*** | (2006.01) |
| ***F04C 18/00*** | (2006.01) |
| ***F04C 29/00*** | (2006.01) |
| ***F04C 18/16*** | (2006.01) |

(56) References Cited

U.S. PATENT DOCUMENTS

| | | | | |
|---|---|---|---|---|
| 5,924,847 | A | 1/1999 | Scaringe et al. | |
| 6,176,092 | B1 | 1/2001 | Butterworth et al. | |
| 8,113,799 | B2 | 2/2012 | Wu et al. | |
| 8,421,297 | B2 * | 4/2013 | Stout | H02K 3/12 310/214 |
| 9,212,667 | B2 | 12/2015 | Sun et al. | |
| 9,228,590 | B2 | 1/2016 | Nachtergaele et al. | |
| 2014/0232227 | A1 | 8/2014 | Ionel et al. | |
| 2014/0371919 | A1 | 12/2014 | Creamer | |
| 2015/0285242 | A1 | 10/2015 | Zhu et al. | |
| 2015/0300708 | A1 | 10/2015 | Kennedy | |

FOREIGN PATENT DOCUMENTS

| | | | |
|---|---|---|---|
| EP | 0867628 | A2 | 9/1998 |
| EP | 3061973 | A1 | 8/2016 |
| JP | S60116892 | A | 6/1985 |
| JP | H01182590 | A | 7/1989 |
| JP | 2006316662 | A | 11/2006 |
| JP | 2014084825 | A | 5/2014 |
| WO | 2004031585 | A1 | 4/2004 |
| WO | 2010061939 | A1 | 6/2010 |
| WO | 2016164453 | A1 | 10/2016 |

OTHER PUBLICATIONS

Parker et al.; "Variable-Speed Oil-Free Centrifugal Chiller with Magnetic Bearings Assessment: George Howard, Jr. Federal Building and U.S. Courthouse, Pine Bliff, Arkansas"; Prepared for the General Services Administration by the Pacific Northwest National Laboratory; Nov. 2012; 43 Pages.

Written Opinion of the International Searching Authority; International Application No. PCT/US2017/065990; International Filing Date: Dec. 13, 2017; dated Feb. 15, 2018; 11 Pages.

Second Office Action; Chinese Application No. 201780077678.1; International Filing Date: Jun. 14, 2019; dated Apr. 7, 2021; 7 pages with translation.

Chinese Office Action; International Application No. 201780077678.1; International Filing Date: Jun. 14, 2019; dated Sep. 8, 2020; 6 pages.

* cited by examiner

SCREW COMPRESSOR WITH MAGNETIC GEAR

CROSS REFERENCE TO RELATED APPLICATIONS

This application is a National Stage application of PCT/US2017/065990, filed Dec. 13, 2017, which claims the benefit of U.S. Provisional Application No. 62/434,742, filed Dec. 15, 2016, both of which are incorporated by reference in their entirety herein.

BACKGROUND

Embodiments of this disclosure relate generally to chiller refrigeration systems and, more particularly, to separation of lubricant from refrigerant in a compressor of a chiller refrigeration system.

Refrigerant systems are utilized in many applications to condition an environment. The cooling or heating load of the environment may vary with ambient conditions, occupancy level, other changes in sensible and latent load demands, and as the temperature and/or humidity set points are adjusted by an occupant of the environment.

Screw-type compressors are commonly used in air conditioning and refrigeration applications. In such a compressor, intermeshed male and female lobed rotors or screws are rotated about their axes to pump the working fluid (e.g. refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone).

The compressor is typically provided with lubricant, such as oil, which is utilized to lubricate bearings and other running surfaces. The oil mixes with the refrigerant, such that the refrigerant leaving the compressor includes a good quantity of oil. This is somewhat undesirable, as in a closed refrigerant system, it can sometimes become difficult to maintain an adequate supply of lubricant to lubricate the compressor surfaces.

SUMMARY

According to a first embodiment, screw compressor includes a casing having a suction port and a discharge port, a male rotor rotatable relative to said casing about a first axis, a female rotor rotatable relative to said casing about a second axis, and a magnetic gear system including a first magnetic gear associated with said male rotor and a second magnetic gear associated with said female rotor. The first magnetic gear and the second magnetic gear are positioned such that a magnetic field of said first magnetic gear interacts with said second magnetic gear to drive rotation of said female rotor about said second axis.

In addition to one or more of the features described above, or as an alternative, in further embodiments said magnetic field of said first magnetic gear interacts with a magnetic field of said second magnetic gear as said first magnetic gear rotates about said first axis to drive rotation of said second magnetic gear about said second axis.

In addition to one or more of the features described above, or as an alternative, in further embodiments rotation of said first magnetic gear about said first axis in first direction drives rotation of said second magnetic gear about said second axis in a second direction opposite said first direction.

In addition to one or more of the features described above, or as an alternative, in further embodiments said first magnetic gear and said second magnetic gear are magnetically aligned to transmit a required torque said first magnetic gear and said second magnetic gear.

In addition to one or more of the features described above, or as an alternative, in further embodiments said first magnetic gear and said second magnetic gear are not arranged in physical contact.

In addition to one or more of the features described above, or as an alternative, in further embodiments said first magnetic gear has a first configuration and said second magnetic gear has a second configuration, said first configuration and said second configuration being identical.

In addition to one or more of the features described above, or as an alternative, in further embodiments said first magnetic gear has a first configuration and said second magnetic gear has a second configuration, said first configuration and said second configuration being distinct.

In addition to one or more of the features described above, or as an alternative, in further embodiments said first magnetic gear and said second magnetic gear form a magnetic gear pair and said magnetic gear system includes a plurality of said magnetic gear pairs.

In addition to one or more of the features described above, or as an alternative, in further embodiments a first magnetic gear pair of said plurality of magnetic gear pairs is positioned adjacent a suction end of said male rotor and said female rotor and a second magnetic gear pair of said plurality of magnetic gear pairs is positioned adjacent a discharge end of said male rotor and said female rotor.

In addition to one or more of the features described above, or as an alternative, in further embodiments comprising a motor operably coupled to said male rotor.

In addition to one or more of the features described above, or as an alternative, in further embodiments said screw compressor is a component of a refrigeration system.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
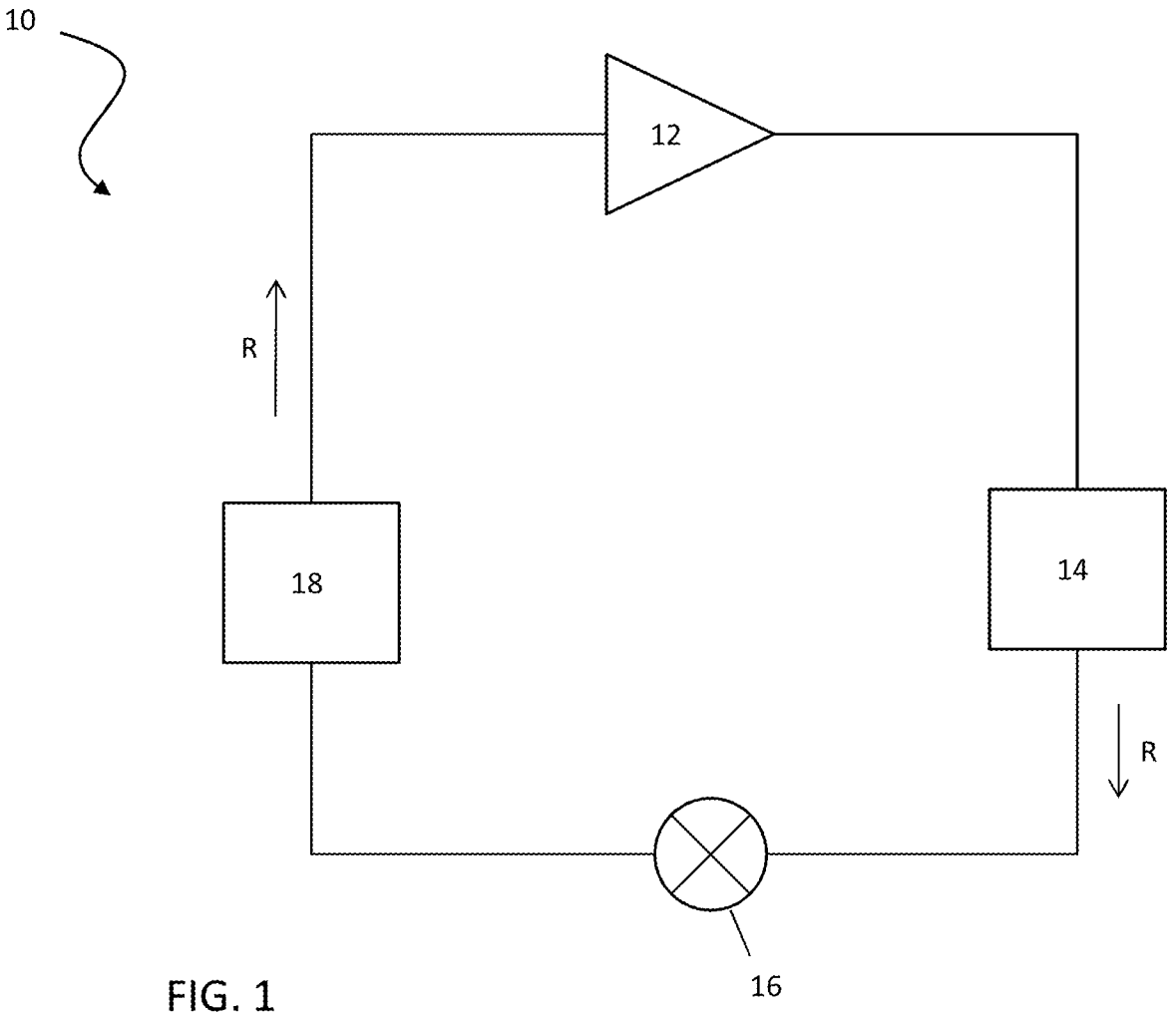
FIG. 1 is a schematic diagram of an example of a refrigeration system

Referring now to FIG. 1, an example of a conventional vapor compression or refrigeration cycle 10 of an air conditioning system is schematically illustrated. A refrigerant R is configured to circulate through the vapor compression cycle 10 such that the refrigerant R absorbs heat when evaporated at a low temperature and pressure and releases heat when condensed at a higher temperature and pressure. Within this cycle 10, the refrigerant R flows in a clockwise direction as indicated by the arrows. The compressor 12 receives refrigerant vapor from the evaporator 18 and compresses it to a higher temperature and pressure, with the relatively hot vapor then passing to the condenser 14 where it is cooled and condensed to a liquid state by a heat exchange relationship with a cooling medium such as air or water. The liquid refrigerant R then passes from the condenser 14 to an expansion valve 16, wherein the refrigerant R is expanded to a low temperature two phase liquid/vapor state as it passes to the evaporator 18. After the addition of heat in the evaporator, low pressure vapor then returns to the compressor 12 where the cycle is repeated.

Figure 2:
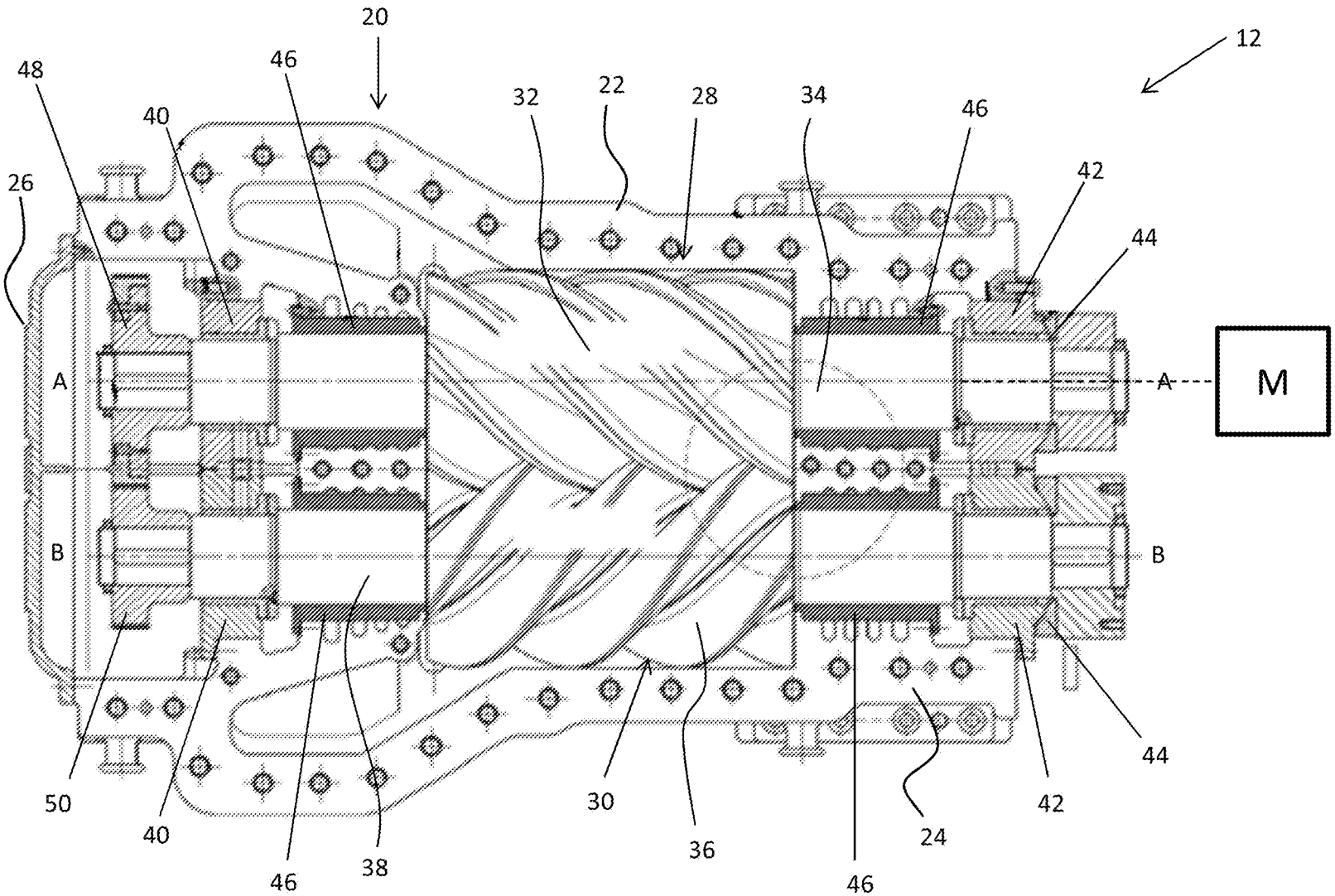
FIG. 2 is a cross-sectional view of an example of a portion of a screw compressor of a refrigeration system.

Referring now to FIG. 2, an example of a portion of a conventional screw compressor 12, commonly used in air conditioning systems, is illustrated in more detail. The screw compressor 12 has a casing assembly 20 including a main casing 22, a discharge side casing 24, and an end cover 26. Mounted within the main casing 22 are a male rotor 28 and a female rotor 30 having respective longitudinal axes A and B. As shown, the longitudinal axes A, B are generally parallel to one another. The male rotor 28 includes a lobed body 32 mounted about a first shaft 34 configured to rotate about longitudinal axis A and the female rotor 30 includes a lobed body 36 mounted about a second shaft 38 configured to rotate about longitudinal axis B. The lobed body 32 of the male rotor 28 and the lobed body 36 of the female rotor 30 may have the same, or alternatively, a different number of teeth formed therein. The male rotor 28 and the female rotor 30 are arranged such that the teeth of the male rotor 28 are interposed with the teeth of the female rotor 30.

One or more bearings, such as a journal bearings for example, may be used to mount the male rotor 28 and the female rotor 30 to the casing 20. For example, a suction end of the shafts 34, 38 of the male and female rotor 28, 30 are mounted to the casing 20 via one or more inlet bearings 40, and a discharge end of the shafts 34, 38 of the male and female rotor 28, 30 are mounted to the casing 20 with one or more outlet bearings 42 for rotation about the associated rotor axis A, B. Alternatively, or in addition, a thrust bearing 44 may be positioned at the discharge end of the rotors 28, 30 to prevent translation of the rotors 28, 30 along their respective longitudinal axes A, B during operation of the compressor 12. In the illustrated, non-limiting embodiment, the thrust bearing 44 is arranged directly adjacent the downstream end of the outlet journal bearings 42. In addition, one or more shaft sealing devices 46 may be provided between the main casing 22 and the respective rotors 28, 30, and between the discharge-side casing 24 and the respective rotors 28, 30.

A pair of timing gears 48, 50 is mounted to the shafts 34, 38 of the male rotor 28 and the female rotor 30, respectively. The timing gear 48 of the male rotor 28 and the timing gear 50 of the female rotor 30 are arranged in intermeshing engagement such that rotation of one of the timing gears, such as the timing gear 48 associated with the male rotor 28 for example, is transmitted to the other timing gear, such as the timing gear 50 associated with the female rotor 30 for example. As a result of this engagement, the timing gears 48, 50 are configured to rotate the male rotor 28 and the female rotor 30 in opposite directions. A motor, illustrated schematically at M, coupled to the shaft 34, 38 of one of the rotors is operable to drive that rotor, illustrated as male rotor 28, about its axis of rotation A. Through the engagement between the timing gears 48, 50, the other rotor 30 is similarly rotated about its respective axis of rotation B. Although a particular compressor type and configuration is illustrated and described herein, other compressors, such as having three rotors for example, are within the scope of the invention.

Figure 3:
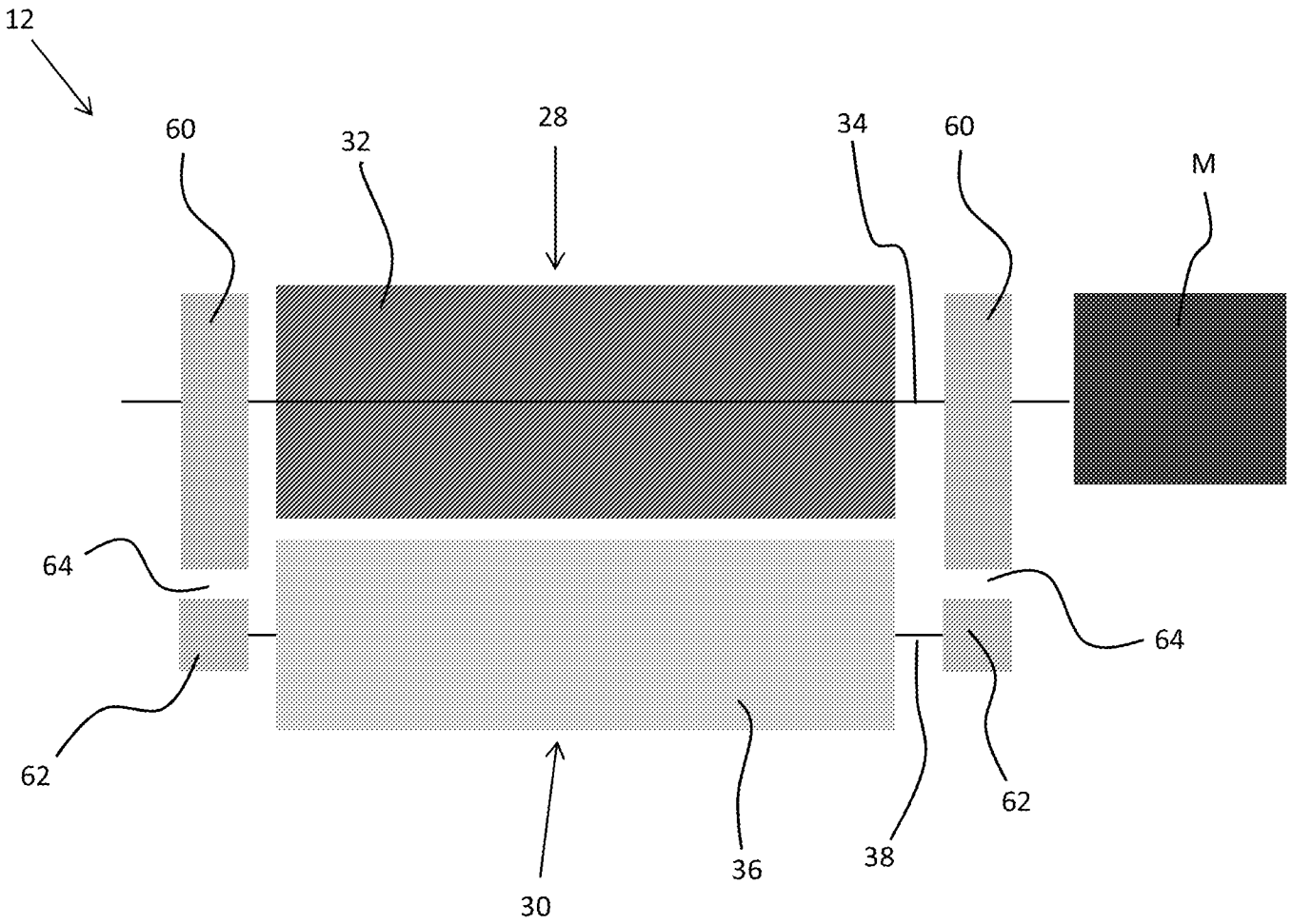
FIG. 3 is a simplified cross-sectional schematic diagram of a screw compressor according to an embodiment.

In some applications, it is desirable to eliminate all or at least a portion of the mechanical components of the screw compressor 12 that require lubrication, such as the timing gears 48, 50 for example. With reference now to FIG. 3, in an embodiment, the timing gears 48, 50 associated with the male rotor 28 and the female rotor 30 of a screw compressor 12 is replaced with magnetic gears 60, 62 respectively. Although the screw compressor 12 is illustrated and described herein with respect to magnetic gears, it should be understood that suitable alternatives, such as magnetic couplers for example, are also considered within the scope of the disclosure. In the illustrated non-limiting embodiment, a pair of magnetic gears 60, 62 is mounted adjacent both the suction side and the discharge side of the rotors 28, 30. However, embodiments having only one pair of magnetic gears 60, 62, or alternatively, having more than two pairs of magnetic gears 60, 62 are also within the scope of the disclosure.

The magnetic gears 60, 62 may be formed from a magnetic material such that an outer surface of the gear 60, 62 is magnetized locally to produce a plurality of small magnetic poles. The interactive magnetic force of the magnetic poles of each gear 60, 62 can function in a manner similar to the teeth of a conventional mechanical gear. As a result, the magnetic field generated by the one or more magnetic gears 60 associated with the male rotor 28 is configured to interact with the magnetic field of the one or more magnetic gears 62 associated with the female rotor 30. Accordingly, torque is transmitted between the magnetic gears 60, 62 by their mutual attraction and repulsion. As a result, rotation of the one or more magnetic gears 60 of the male rotor 28 drives rotation of the one or more magnetic gears 62 of the female rotor 30, thereby causing the female rotor 30 to rotate about its axis B. An air gap, illustrated schematically at 64, is arranged between the magnetic gears 60, 62 such that the gears 60, 62 are not in physical contact with one another.

The size and configuration of each of the magnetic gears 60, 62 in the compressor 12 may be selected based on the desired torque transmission. The parameters that affect the magnitude of the torque transmitted between bi-axial magnetic gears 60, 62 include: the distance between magnetic gears 60, 62, the thickness of a magnetic material layer of the magnetic gears 60, 62, the thickness of a magnetic conducting material layer of the gears 60, 62, the number of magnetized poles in the magnetic gears 60, 62, and the internal and external radius of the magnetic material layer. In an embodiment, the configuration of the magnetic gears 60 associated with the male rotor 28 is substantially identical to the configuration of the magnetic gears 62 associated with the female rotor 30. However, in other embodiments, the magnetic gears 60, 62 associated with the male and female rotor 28, 30 may be different. Further, in embodiments of the screw compressor 12 including a plurality of magnetic gear pairs, each of the magnetic gears 60 associated with the male rotor 28 is substantially identical, and each of the magnetic gears 62 associated with the female rotor 30 is identical so that torque is transmitted uniformly between each pair of magnetic gears 60, 62.

By using a magnetic gears 60, 62 to synchronize rotation of the rotors 28, 30 of the screw compressor 12, the non-contact operation thereof eliminates the need for lubrication, thereby reducing both contamination and the cost of the system. Further the magnetic gears 60, 62 eliminate problems related to friction and wear which improves the efficiency by reducing frictional losses of the system. As a result, the magnetic gears lead to longer component life while reducing both the noise and vibration caused by the rotation of the rotors 28, 30.

While the disclosure has been described in detail in connection with only a limited number of embodiments, it should be readily understood that the disclosure is not limited to such disclosed embodiments. Rather, the invention can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A screw compressor comprising:

a casing having a suction port and a discharge port;

a male rotor rotatable relative to said casing about a first axis;

a female rotor rotatable relative to said casing about a second axis; and a magnetic gear system including a first magnetic gear associated with said male rotor and a second magnetic gear associated with said female rotor, said first magnetic gear and said second magnetic gear being positioned such that a magnetic field of said first magnetic gear interacts with said second magnetic gear to drive rotation of said female rotor about said second axis;

wherein said first magnetic gear and said second magnetic gear form a magnetic gear pair of a plurality of magnetic gear pairs, wherein a first magnetic gear pair of said plurality of magnetic gear pairs is positioned adjacent a suction end of said male rotor and said female rotor and a second magnetic gear pair of said plurality of magnetic gear pairs is positioned adjacent a discharge end of said male rotor and said female rotor, wherein each magnetic gear of the plurality of magnetic gears associated with said male rotor is substantially identical, and each magnetic gear of said plurality of magnetic gears associated with said female rotor is substantially identical.

2. The screw compressor of claim 1, wherein said magnetic field of said first magnetic gear interacts with a magnetic field of said second magnetic gear as said first magnetic gear rotates about said first axis to drive rotation of said second magnetic gear about said second axis.

3. The screw compressor of claim 2 wherein rotation of said first magnetic gear about said first axis in first direction drives rotation of said second magnetic gear about said second axis in a second direction opposite said first direction.

4. The screw compressor of claim 1, wherein said first magnetic gear and said second magnetic gear are magnetically aligned to transmit a required torque between said first magnetic gear and said second magnetic gear.

5. The screw compressor of claim 1, wherein said first magnetic gear and said second magnetic gear are not arranged in physical contact.

6. The screw compressor of claim 1, wherein said first magnetic gear has a first configuration and said second magnetic gear has a second configuration, said first configuration and said second configuration being identical.

7. The screw compressor of claim 1, wherein said first magnetic gear has a first configuration and said second magnetic gear has a second configuration, said first configuration and said second configuration being distinct.

8. The screw compressor of claim 1, further comprising a motor operably coupled to said male rotor.

9. The screw compressor of claim 1, wherein said screw compressor is a component of a refrigeration system.

* * * * *